United States Patent [19]

Schwartz

[11] 4,354,330

[45] Oct. 19, 1982

[54] FLAT-CORNERED TRIANGULAR MEDICAL COLUMN

[75] Inventor: Wesley W. Schwartz, Oshkosh, Wis.

[73] Assignee: Square D Company, Palatine, Ill.

[21] Appl. No.: 221,871

[22] Filed: Dec. 31, 1980

[51] Int. Cl.[3] ..... A47B 83/00; A61G 7/06

[52] U.S. Cl. ..... 52/28; 312/238; 128/630; 128/906

[58] Field of Search ..... 52/28, 173; 174/48; 312/238; 128/630, 906

[56] References Cited

U.S. PATENT DOCUMENTS

| | | | |
|---|---|---|---|
| 1,597,834 | 8/1926 | Scudder | 312/238 |
| 3,032,057 | 5/1962 | Mays | 52/173 |
| 3,462,892 | 8/1969 | Meyer | 52/28 |
| 3,660,591 | 5/1972 | Schultz et al. | 52/28 |
| 3,762,298 | 10/1973 | Schefke et al. | 128/2 R |
| 3,769,502 | 10/1973 | Schultz et al. | 52/28 |
| 3,921,345 | 11/1975 | Damico | 52/28 |

*Primary Examiner*—James L. Ridgill, Jr.

*Attorney, Agent, or Firm*—Carmen B. Patti; John R. Garrett; Richard T. Guttman

[57] ABSTRACT

A medical power service column for use in a hospital room for supplying electrical power, lighting and gases and also for providing a centralized support for medical equipment. The medical column comprises a base, a wall enclosure and a top cover all having a unique flat-cornered cross-sectional shape. The flat-cornered triangular shape of the medical column allows free access to a patient in a hospital bed while supporting medical equipment in close proximity to the patient.

6 Claims, 9 Drawing Figures

FLAT-CORNERED TRIANGULAR MEDICAL COLUMN

CROSS-REFERENCE TO RELATED APPLICATIONS

This application relates to, but is no way dependent upon copending application of common ownership Ser. No. 221,875 filed Dec. 31, 1980.

BACKGROUND OF THE INVENTION & PRIOR ART STATEMENT

This invention relates in general to medical power service columns for use in hospital rooms and in particular to a medical column having a flat-cornered triangular shape. Conventionally, medical walls and columns are structures which house electrical, medical and gas equipment for use in hospital rooms, especially intensive care rooms and coronary care rooms. These structures are usually prefabricated in portions or totally at a manufacturing plant and are then installed in hospital rooms and connected to electrical power distribution systems, patient monitoring systems and gas supplies in the ceiling, walls or floors of the room. Although medical columns have been used in the past, medical walls are more common. The following patents illustrate some of the prior art.

U.S. Pat. Nos. 3,769,502 and No. 3,660,591 disclose medical walls currently in use in hospitals. The medical wall disclosed has a head wall portion and two wedge shaped sections which project from the opposite vertical edges of the wall section. The medical wall contains various electrical and gas outlets and other medical and electrical equipment. The medical wall disclosed as best shown in FIG. 1 of U.S. Pat. No. 3,769,502 and U.S. Pat. No. 3,660,591 is permanently attached to the wall and has the disadvantage that, because of the wings or side sections, hospital personnel are hampered in getting to the patient without moving the bed out away from the medical wall. Although the wall may be suitable for normal hospital rooms, in intensive care and coronary care rooms where the beds are not positioned necessarily against the wall, they would have little or no use. Column 1, lines 35 to 67 and Column 2, lines 1 to 50 of U.S. Pat. No. 3,769,502 and Column 1, lines 26 to 75 and Column 2, lines 1 to 28 of U.S. Pat. No. 3,660,591 set forth the pertinent features and summary of the invention of the disclosed medical walls.

U.S. Pat. No. 3,462,892 discloses a typical manner of construction of medical walls. The structure generally comprises a pair of horizontal members and a plurality of vertical members interconnecting the horizontal members. Spaced apart channel members are supplied for supporting various medical and electrical equipment and outlets. FIG. 5 and lines 20 to 63 of Column 2 in U.S. Pat. No. 3,462,892 best illustrate the type of construction disclosed. The construction disclosed although adequate for medical walls would not be sufficient or practical for medical columns. Since the column is positioned away from the wall in the hospital room the type of construction would need to be substantially stronger and would require more than covering both sides of the frame work with face panels. Such a medical column formed from a medical wall would be lacking in structural strength without extensive redesign.

U.S. Pat. No. 3,762,398 discloses a medical column which is movable in the room and which may also be positioned against a wall of the room. The disclosed medical column is best shown in FIG. 4 and described in Column 5, lines 3 to 17. As can be seen from the drawing, the medical column is large and requires a substantial amount of space in the hospital room. This is a disadvantage in that most hospital rooms do not have a sufficient amount of space for a medical column of this size. Also a severe disadvantage is the fact that the medical column must be connected by electrical and gas lines to the wall of the room thereby preventing anyone from walking totally around the medical column as may be necessary in emergency situations.

U.S. Pat. No. 3,032,057 discloses another medical column for use in an operating room which is attached only to the ceiling and may be pulled down when in use, or pushed back up toward the ceiling when not in use. The disclosed medical column is best described in Column 2, lines 53 to 73 and Column 3, lines 1 to 10. The disadvantage of the column is that, although it may be pushed up towards the ceiling, a typical hospital room has an 8' ceiling and there would not be sufficient clearance for a person to walk under the column. In addition, if the column were bumped into in either the extended position or in the non-extended position there is a danger of disturbing medical equipment mounted on the column or of perphaps actually loosening the column from its attachment at the ceiling. Another disadvantage of the column is that it also obscures visibility of the hospital room.

The relevance of the prior art indicated in the present specification should not be given a limited interpretation. The prior art is the closest prior art of which applicant is aware and should not be construed as a representation that no better art exists or that a search has been made. A cited prior art item may be found to have relevance in a passage other than the one referred to, or to have relevance in a sense different than as stated.

OBJECTS OF THE INVENTION

It is a general object of the present invention to provide an improved medical power service column for use in a hospital room.

It is another object of the present invention to provide a medical power service column which allows substantially free access to the patient in bed located in the hospital room.

It is a further object to provide a more versatile medical power service column.

It is another object to provide a medical power service column which is easier and cheaper to manufacture.

BRIEF DESCRIPTION OF THE DRAWINGS

The features of the present invention which are believed to be novel are set forth with particularity in the appended claims. The invention together with further objects and advantages may best be understood by reference to the following description taken in conjunction with the accompanying drawings, in the several figures of which like reference numerals indentify like elements, and in which:

DESCRIPTION OF THE PREFERRED EMBODIMENT

Figure 1:
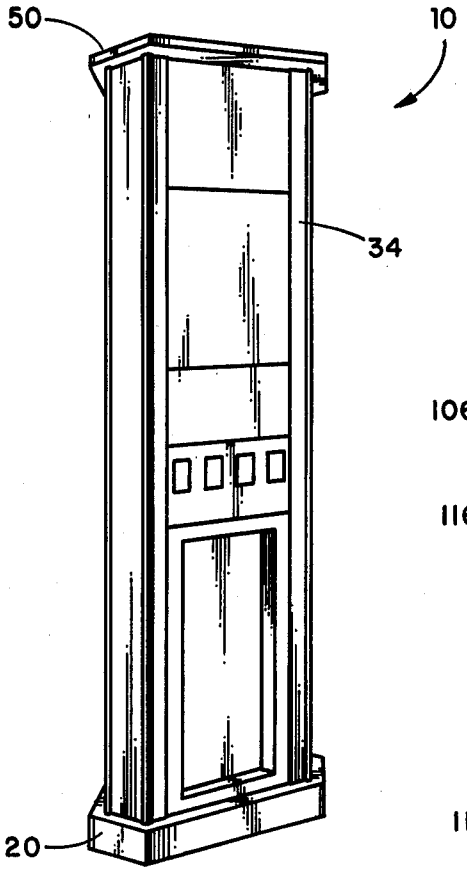
FIG. 1 is a perspective view of the novel medical power service column.

Whereas the invention may be implemented in various types of medical power service columns, it is preferably embodied in a column of the nature shown in FIG. 1. The medical power service column is especially useful in hospital rooms designated for intensive care and for coronary care. The medical column allows personnel to move freely in the room. In addition, the novel shape of the medical column allows free access to the patient in the bed as will be described later. The medical column is extremely versatile in the positioning of electrical and medical equipment and electrical and gas outlets on the column. Also, the novel medical column may be prefabricated in a manufacturing plant and shipped in sections or intact to the hospital where it can be used in new construction or in remodeling.

The novel medical power service column 10 is for use in a hospital room having a floor and ceiling and sources of electricity and gases. The medical column 10 supplies electrical power, lighting and gases and also provides a centralized support for medical equipment.

In the preferred embodiment the medical power service columm 10 extends completely between the floor and the ceiling of the hospital room. However, it is envisioned that it would not be necessary for the medical column to extend entirely to the ceiling. Although in the preferred embodiment the medical column 10 is attached both to the floor and ceiling of the hospital room the construction of the medical column 10 is such that only attachment to the floor may be utilized allowing a "free standing" version of the medical column 10.

Figure 7:
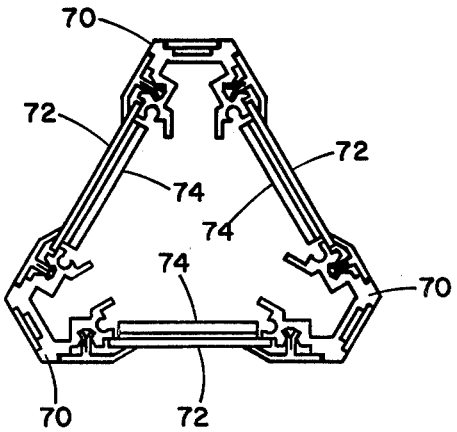

The medical power service column 10 will now be described. The medical power service column 10 has a flat-cornered triangular cross-sectional shape as best shown by the portion of the medical column illustrated in FIG. 7, and which will be described in greater detail later. However, the shape shown in FIG. 7 is applicable to the overall novel shape of the medical column 10 and illustrates the configuration which has been given the term "flat-cornered triangular shape".

The flat-cornered triangular shape is another feature of the present invention. By positioning the medical column such that one of the corners of the column is next to the patient's bed, hospital personnel are not hampered in administering to the patient. The novel medical column allows free access to the patient while supporting medical equipment in close proximity to the patient. The novel flat-corners of the medical column allow efficient use of space on the column and are designed to house electrical or gas outlet boxes.

Referring now to FIGS. 2 to 5, the medical column 10 is for use in a hospital room having a floor 12 and a ceiling 14. The hospital room has sources of electricity 16 and gases 18. These are shown schematically in FIG. 5 and it should be understood that there would be more than one electrical line and more than one gas line running to the medical column 10. Also it should be understood that the electrical lines would be both high voltage and low voltage lines. The medical column 10 comprises a base 20 having a flat-cornered triangular cross-sectional shape and also has means 22 for attaching the base 20 to the floor 12 of the hospital room. In the preferred embodiment, the means 22 for attaching the base 20 comprises a jack screw 24 threaded into a bracket 26 for making minor adjustments in the height and leveling of the medical column 10. Angle brackets 28 are bolted to the floor 12 with bolts 30 to prevent sideways movement of the medical column 10. Preferably, three means 22 would be utilized and would be positioned on the base 20 near each of the corners of the base 20. Once the medical column 10 has been positioned, any gap which may occur between the base 20 and the floor 12 can be concealed with conventional cove molding 32 which can be attached to the base 20.

The medical column 10 further comprises a wall enclosure 34 having an upper end 36 and a lower end 38 attached to the base 20. The wall enclosure 34 has a flat-cornered triangular cross-sectional shape of slightly less dimension than the base 20. The wall enclosure 34 contains electrical equipment 40 and electrical and gas supply lines 42 and 44 schematically shown in FIG. 5 and supports various electrical and medical devices such as electrical and gas outlets and means for holding medical equipment on its outer surface. A more detailed listing of these devices will be given later. In addition the wall enclosure 34 has provisions 46 and 48 for attaching the electrical and gas lines 42 and 46 to the electrical and gas supplies 16 and 18 in the ceiling 14 of the hospital room.

The medical column 10 also comprises a top cover 50 in close proximity to the ceiling 14 of the hospital room. The top cover 50 also has a flat-cornered triangular shape corresponding to the base 20. The top cover 50 is attached to the upper end 36 of the wall enclosure 34 and has an aperture 52 for receiving the sources 16 and 18 of electricity and gases. The top cover 50 further has means 54 for attaching the medical column 10 to the ceiling 14 of the hospital room. The means 54 comprises a threaded rod 56 embedded in the ceiling 14 to which is attached a nut 58. The threaded rod 56 passes through holes 60 located in the top cover 50. In the preferred embodiment three means 54 are used for attaching the top cover 50 and are positioned near each corner of the top cover 50.

Figure 6:
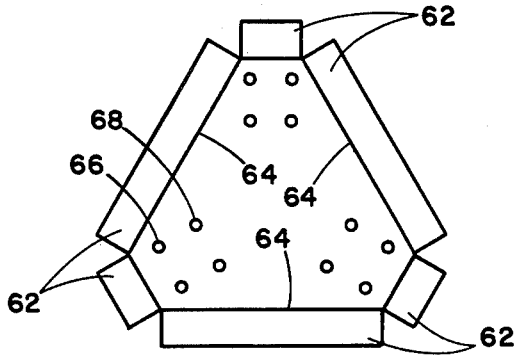
FIGS. 6 and 7 are top views of various sections of the novel medical power service column.

The details of construction of the medical column will now be discussed. The base 20 of the medical column 10 may be formed from a single flat sheet of steel by cutting from the sheet of steel a configuration as shown in FIG. 6. The perpherial tabs 62 are folded down along line 64 and the opened seams are welded shut. Holes 66 are provided for securing the wall enclosure 34 and holes 68 are provided for securing the means 22 for attaching the base 20 to the floor 12 of the hospital room. The welded seams are finished and the base is appropriately painted to complete the assembly. The top cover 50 is formed in a similar manner.

Figure 8:
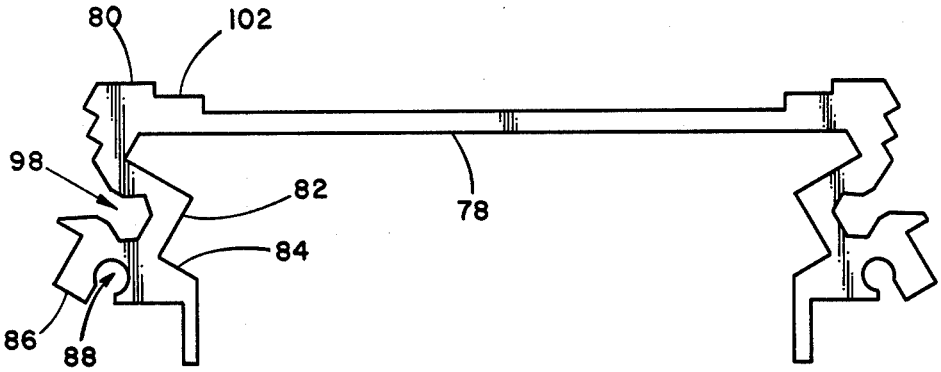
FIG. 8 is a cross-sectional view of the main type of support beam used in construction of the medical column.
Figure 9:
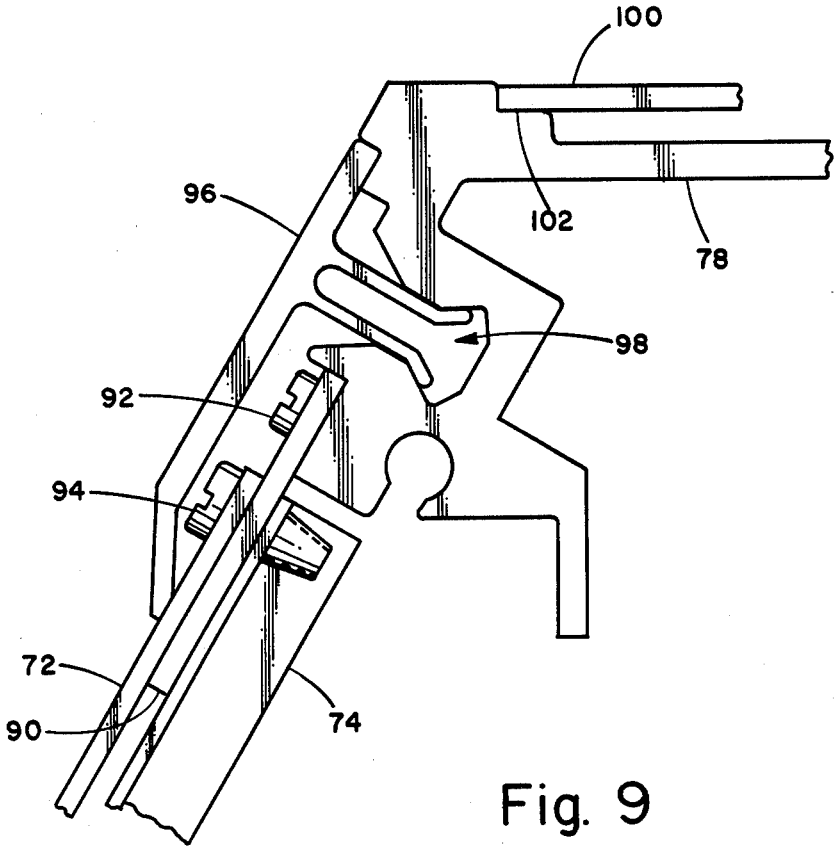
FIG. 9 is a cross-sectional view detailing the attachment of various components to the support beam.

As shown in FIG. 7 the wall enclosure 34 comprises three support beams 70 having upper and lower ends. Three face panels 72 are attached between the support beams 70 to form the flat-cornered triangular shape and support rails 74 are attached to the support beams 70 and located directly behind the face panels 72 for supporting electrical and gas outlet boxes and other equipment. The support rails 74 form a typical construction of two angle iron sections or channels between which an electrical box, for example, can be attached at the top and bottom of the electrical box. FIG. 8 shows a cross-section of the support beams 70. The support beam 70 comprises a flat body section 78 to which is attached a corner portion 80. A trim strip holding section 82 is attached to the other side of the corner portion 80. Attached to the trim strip holding section 82 is a support beam attachment section 84 and a face panel attachment section 86. The support beams 70 used in the wall enclosure 34 are attached to the base 20 by inserting a screw through holes 66 in the base 20 and into the hole like opening 88 of the support beam attachment structure 84. The top cover 50 is attached in a similar manner to the upper ends of the support beams 70. In the preferred embodiment the support beams 70 are made from extruded aluminum pieces and the screws are self-tapping screws which thread the aluminum in the support beam attachment section 84. As shown more clearly in FIG. 9, a metal support strip 90 is first attached to the face panel attachment section 86 with screw 92. The face panel 72 and the support rails 74 are then attached to the support strip 90 with screw 94. A plastic trim strip 96 snaps into the opening 98 in the trim strip holding portion 82 and covers screws 92 and 94 thereby giving a smooth overall finish to the medical column. In the preferred embodiment a decorative panel 100 is positioned over the flat body 78 and is located in seats 102 near corner portion 80.

In the preferred embodiment all support beams 70 are formed from extruded aluminum and the face panels 72 are sheet metal with a finished surface. The base 20 and top cover 50 are also sheet metal with a finished surface. In the preferred embodiment the face panels 72 of the wall enclosure 34 have light emitting portions 104 near top cover 50 and behind which florescent lights (not shown) are positioned. One, two or all three of the face panels 72 in the wall enclosure 34 may be used for room lighting. It has been found that two or three lights in the wall enclosure 34 near the top cover 50 supply sufficient room lighting for a hospital room.

Although the preferred embodiment is shown having the electric and gas sources 16 and 18 being in the ceiling 14 of the hospital room, the novel medical column can easily be adapted to have the provisions 46 and 48 for attaching the electrical and gas lines 42 and 44 in the base 20 for use when the sources 16 and 18 of electricity and gases are contained in the floor 12 of the hospital. An additional opening would then be provided in the base 20 for the electric and gas lines 42 and 44.

Figure 2:
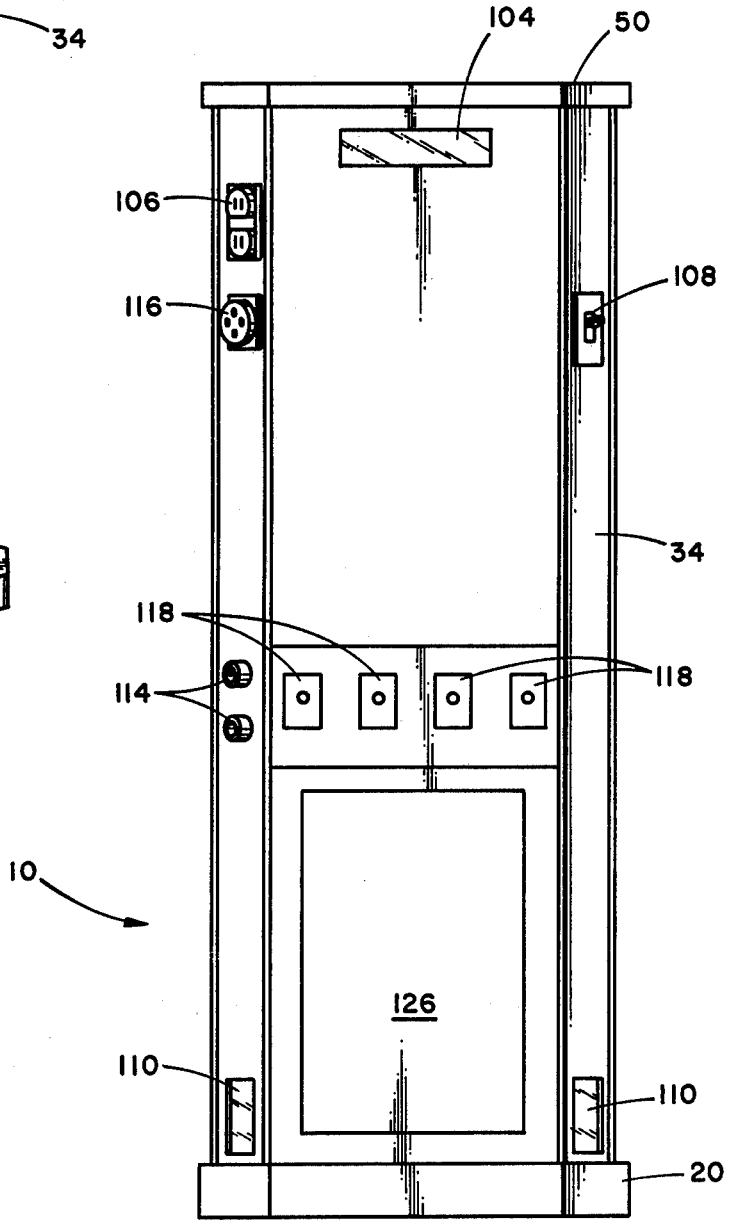
FIGS. 2 to 4 are different side views of the medical column.
Figure 3:
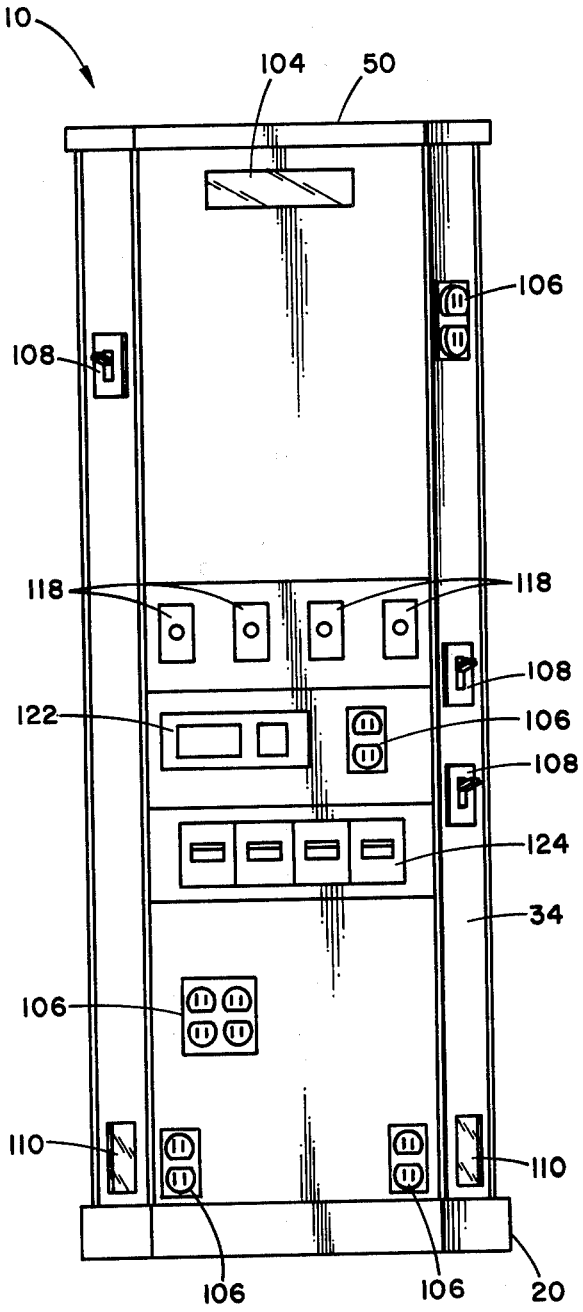
Figure 4:
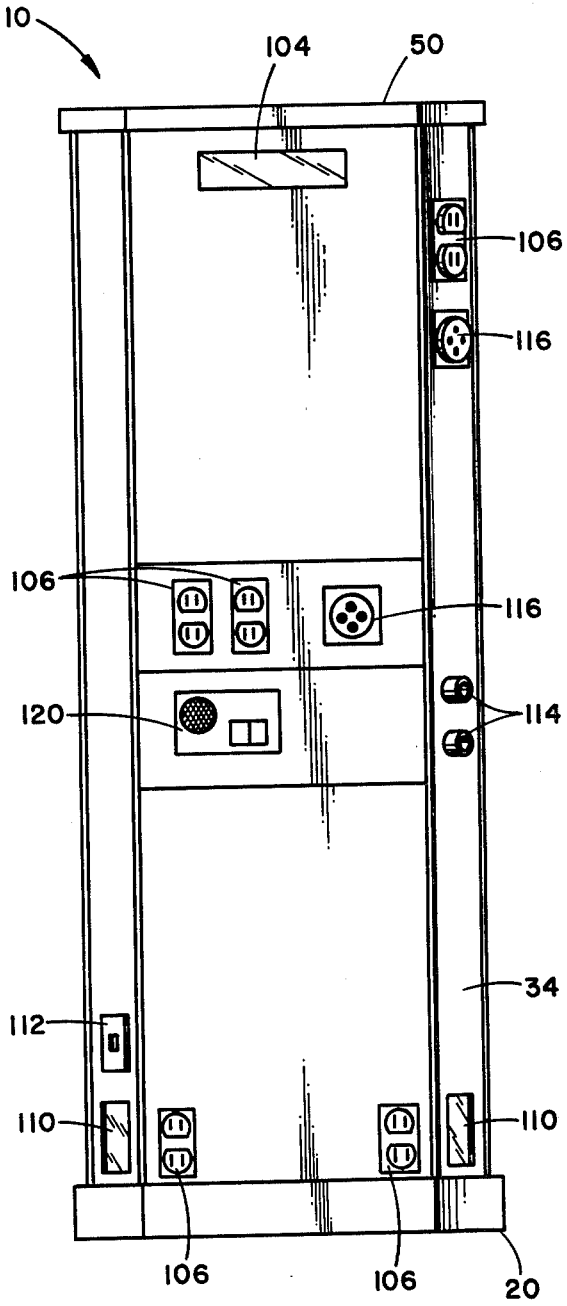
Figure 5:
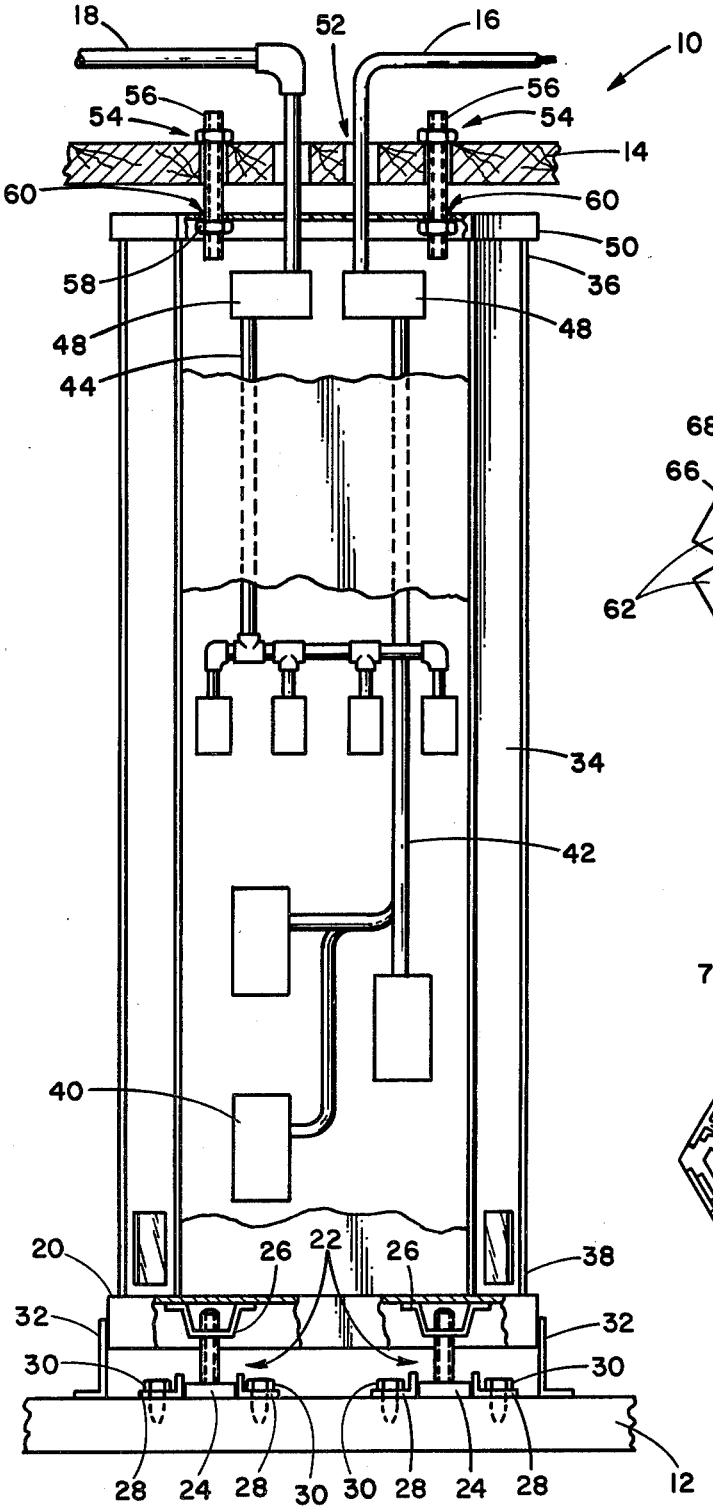
FIG. 5 is a schematic representation of the medical column showing attachment and placement of electrical and gas supply lines and also the means of attachment of the medical column to the floor and/or ceiling of the hospital room.

The novel medical column is designed so that medical and electrical devices and equipment may be placed wherever necessary for the multitude of applications for which the column may be used. FIGS. 2 through 4 of the novel medical column give one example of how equipment may be placed on the column. The wall enclosure 34 contains various electrical equipment such as transformers, circuit breakers, and line isolation monitors, as well as other electrical equipment. Located on the outer surface of the wall enclosure 34 are electrical receptacles 106, electrical switches 108, night lights 110, a telephone jack 112, electrical ground jacks 114, low voltage plugs 116 for relaying the signal output of medical equipment to remote locations, gas outlets 118, a nurse call intercom station 120, the controls 122 for a line isolation monitor, a row of circuit breakers 124 and a vacuum bottle tub 126.

Numerous other features and options can be included with the medical column. For example, a digital clock read-out could be substituted for one of the light emitting portions 104 in the wall enclosure 34. Also, exam lights and direction lights could be attached to the flat-corners of the wall enclosure 34 near the top cover 50.

The invention is not limited to the particular details of the apparatus depicted and other modifications and applications are contemplated. For example, the invention is not limited to the specific "flat-cornered triangular shape" disclosed but may have other similar cross-sectional configurations. Certain other changes may be made in the above described apparatus without departing from the true spirit and scope of the invention herein involved. It is intended therefore that the subject matter in the above depiction shall be interpreted as illustrative and not in a limiting sense.

I claim:

1. A medical power service column for use in a hospital room having a floor and ceiling and sources of electricity and gases, said medical column supplying electrical power, lighting and gases and also providing a centralized support for medical equipment, said medical column comprising:

a base having a flat-cornered triangular cross-section shape;

a wall enclosure having an upper end and a lower end attached to said base, and having a flat-cornered triangular cross-sectional shape in alignment with said base, said wall enclosure containing electrical and gas supply lines and electrical equipment and supporting electrical and gas outlets and means for holding medical equipment on its outer surface, said wall enclosure comprising;

three support beams having upper and lower ends located at each of the corners of said wall enclosure, said lower ends of said support beams being attached to said base, three face panels attached between said support beams to form said flat-cornered triangular shape, and support rails attached to said support beams and located directly behind said face panels for supporting electrical and gas outlet boxes and other equipment;

a top cover attached to said upper ends of said three support beams and covering the upper end of said wall enclosure, said top cover having a flat-cornered triangular shape in alignment with said wall enclosure, said top cover also having an aperture for receiving said sources of electricity and gases; and wherein said medical column is positioned such that one of the corners of said medical column is next to a patient's bed; and wherein said flat-cornered triangular shape of said medical column allows free access to a patient in the hospital bed while supporting medical equipment in close proximity to the patient.

2. The device described in claim 1, wherein said medical column has electrical and gas lines extending through said wall enclosure, and wherein said electrical and gas lines are coupled with the hospital's sources of electricity and gases and extend through said top cover and not through said base when said source is located only in the hospital ceiling, said electrical and gas lines extending through said base and not through said top cover when said source is located only in the hospital floor, said electrical and gas lines being attached to said electrical equipment, said electrical and gas outlets, and said electrical switches.

3. The device described in claim 1, wherein said medical column extends completely between the floor and ceiling of the hospital room.

4. The device described in claim 1, wherein said base has means for anchoring said medical column to the floor of the hospital room.

5. The device described in claim 1, wherein said top cover is in close proximity to the ceiling of the hospital room and wherein said roof cover has means for anchoring said medical column to the ceiling of the hospital room.

6. The device described in claim 1, wherein at least one of said face panels of said wall enclosures has light emitting portions near said top cover for providing room lighting for the hospital room, said wall enclosure also having electric lights located behind said light emitting portion for supplying said room lighting.

* * * * *